US005660353A

United States Patent [19]

Adams, Jr. et al.

[11] Patent Number: 5,660,353

[45] Date of Patent: Aug. 26, 1997

[54] FELT ROLLER

[76] Inventors: John Q. Adams, Jr., Rt. #1 Box 1270, Cusseta, Ga. 31805; John Q. Adams, Sr., 3703 Glenn Rd., Columbus, Ga. 31909

[21] Appl. No.: 623,716

[22] Filed: Mar. 29, 1996

[51] Int. Cl.[6] ..... B65H 16/02; B65H 75/40

[52] U.S. Cl. ..... 242/557; 52/749.12; 242/919

[58] Field of Search ..... 242/557, 403.1, 242/553.8, 918, 919; 52/749.12

[56] References Cited

U.S. PATENT DOCUMENTS

| | | | |
|---|---|---|---|
| 1,016,490 | 2/1912 | Grigg | 242/557 |
| 1,403,692 | 1/1922 | Kahn | 242/557 |
| 1,583,868 | 5/1926 | Berger | 242/403.1 |
| 3,332,827 | 7/1967 | Griffith et al. | 242/557 |
| 3,559,914 | 2/1971 | Alderman | 242/557 |
| 3,992,847 | 11/1976 | Heath | 52/749.12 |
| 4,460,433 | 7/1984 | Boyd | 242/557 |
| 4,711,407 | 12/1987 | Boon | 242/557 |
| 5,213,278 | 5/1993 | Holbek et al. | 242/557 |
| 5,491,952 | 2/1996 | Alderman et al. | 242/557 |

FOREIGN PATENT DOCUMENTS

| | | | |
|---|---|---|---|
| 591567 | 2/1978 | U.S.S.R. | 52/749.12 |
| 700622 | 11/1979 | U.S.S.R. | 52/749.12 |
| 1745847 | 7/1992 | U.S.S.R. | 52/749.12 |

*Primary Examiner*—John M. Jillions

[57] ABSTRACT

A felt roller serves as a device for the application of felt paper in a pitched roof environment and which is capable of being maneuvered by use of the provided handle which is attached at each end of a center axle. The axle supports a roller pin assembly and a caster assembly. The caster assembly utilizes two caster wheels to gain multi-directional maneuverability. The caster wheels are restricted in their movement to allow left, right and up directions of movement when on a roof thus offering control and stability of the felt roller unit. The roller pin assembly provides free spinning rotation of the felt roll as needed for stationary dispensing as well as tack and roll applications. The axle includes on the upper end a support wheel which is removable so as to allow loading of a roll of felt material. The handle is pivotable on the axle and extends outwardly to allow the felt roller unit to be guided from above. A controlled descent can be attained by tilting the unit to a non-vertical position by grasping the handle in its center position, then guiding the unit down as desired, and returning it to a vertical position to stop the descent by gravity induced rotation of the caster wheels to a position perpendicular to the length of the device.

7 Claims, 5 Drawing Sheets

FELT ROLLER

FIELD OF THE INVENTION

In the field of residential construction the device relates to the application of felt paper, in roll form, to a pitched roof to form a vapor barrier in preparation of shingle applications.

DESCRIPTION OF THE RELATED ART

Relating to the act of applying felt paper it has been previously required to manipulate a roll of felt material by hand in such a manner as to guide the roll along backwards from its side while the user is in a crouched position. This results in a time consuming procedure with considerable risk of personal injury.

SUMMARY OF THE INVENTION

It is an objective of the invention to maneuver and dispense felt paper in a safe and swift manner on a pitched roof environment and to allow for free spinning stationary dispensing as well as tack and roll dispensing in the left, right or up directions. Left and right mobility as well as the ability to maintain a stationary position with little physical effort is achieved by way of the gravity induced rotation of two caster wheels located at the lower end of the device into a locked direction perpendicular to the length of the device or the roll rotation axis. A handle extending from the upper end of the device continues up and out to a point such as to allow for operation from an uphill, standing position. At such point the handle then arcs to extend back across center in a direction parallel with the device. From such point the unit can be maneuvered up or down a roof and then returned to a vertical position which results in the locked direction of the caster wheels. The handle angles down to the lower end of the device and is attached in such a manner as to allow for pivoting of the handle.

DETAILED DESCRIPTION OF THE INVENTION

Figure 5:
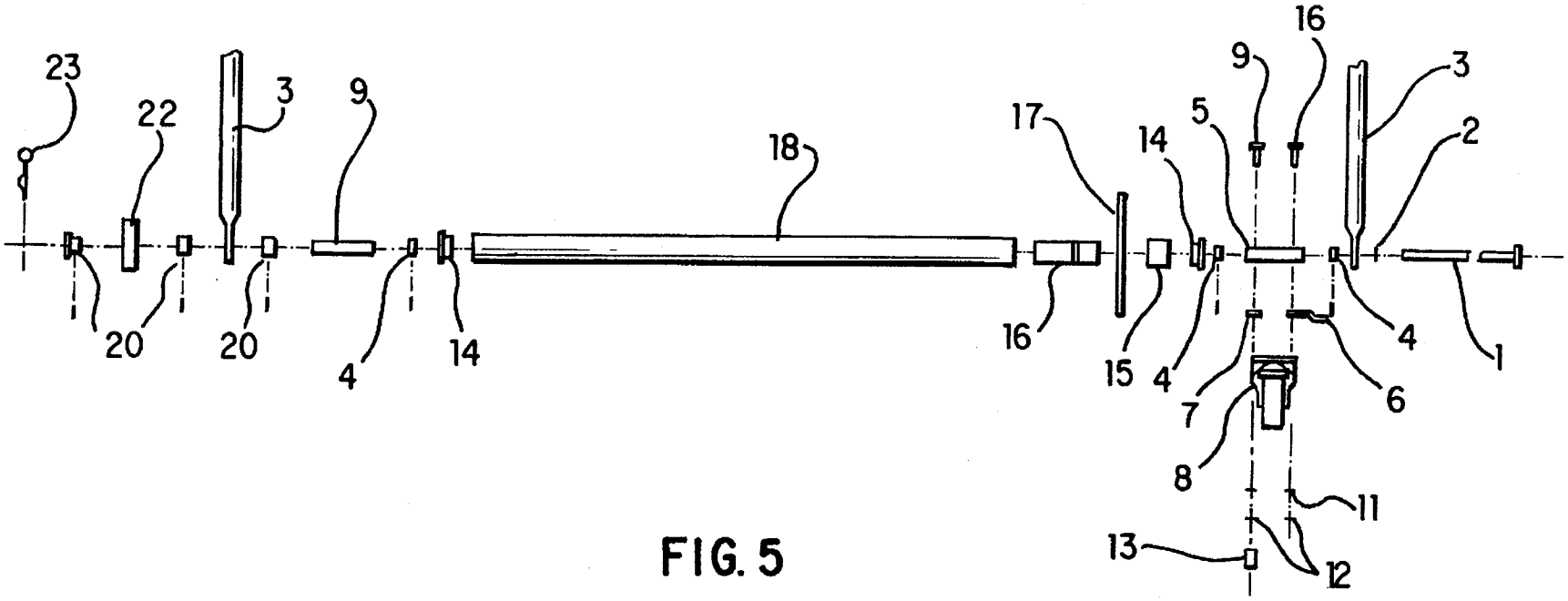
FIG. 5 is a exploded side view of the invention displaying all its related parts and their order of assembly.

Referring to the drawings and FIG. 5 in particular the felt roller unit includes an axle rod 1 of ½" diameter with a 1¼" cap affixed to one end so as to retain the components thereon. A 1¼" washer 2 precedes the handle 3 which consists of ¾" tubing flattened and bored at each end to accept the axle 1 and allow for pivoting of the handle on the axle. Two retainer rings 4 are provided of such type as to include set screws for fixed positioning of the retainer rings on the axle 1 to give adequate spacing for the caster mounting plate 5. Caster mounting plate 5 receives the axle 1 through a 4"×¾" tubing affixed thereon.

Directly below the mounting plate 5 are stop bars 6 which extend into the path of handle 3 to limit the pivoting of handle 3 in both directions of rotation from its centered position. This assures an upright position of the felt roller unit at all times. The stop bars 6 are positioned between the caster wheels 8 and mounting plate 5 using ¼"×¾" hex bolts 10 thus requiring spacers 7 adjacent points of attachment where ¼"×1¼" hex bolts 9 are utilized. The hex bolts 9 extend into the path of rotation of the caster wheels for the purpose of restricting or limiting the rotation of each caster wheel to an arc of 180 degrees. Hex bolts 9 and 10 are secured with lock washers 11 and hex nuts 12. Hex bolts 9 are also provided with rubber sleeves 13 so as to protect the threads thereon upon contact with the caster wheels 8. Such contact would position and lock the caster wheels 8 in a wheel alignment perpendicular to the length of the device or the roll rotation axis and is a gravity induced reaction to the roof pitch thus providing complete stability in maintaining stationary positions and left or right applications.

Beyond the caster wheel assembly the axle 1 supports the roller pin assembly which is held in assembled position by use of a third retainer ring 4. The roller pin assembly serves to support and dispense the felt paper and comprises two beatings 14 of such type as to provide a body diameter and flange diameter adequate to enable the bearings to be inserted to the point of the flange into the roller pin 18 and the roller pin end piece 15. The roller pin and end piece are of PVC plastic pipe and are affixed at either side of the clear Plexiglas support plate 17 by an inner sleeve 16 with an outside diameter equal to the inner diameter of the roller pin 18, end piece 15 and support disk 17 which in turn secures all three components.

Figure 1:
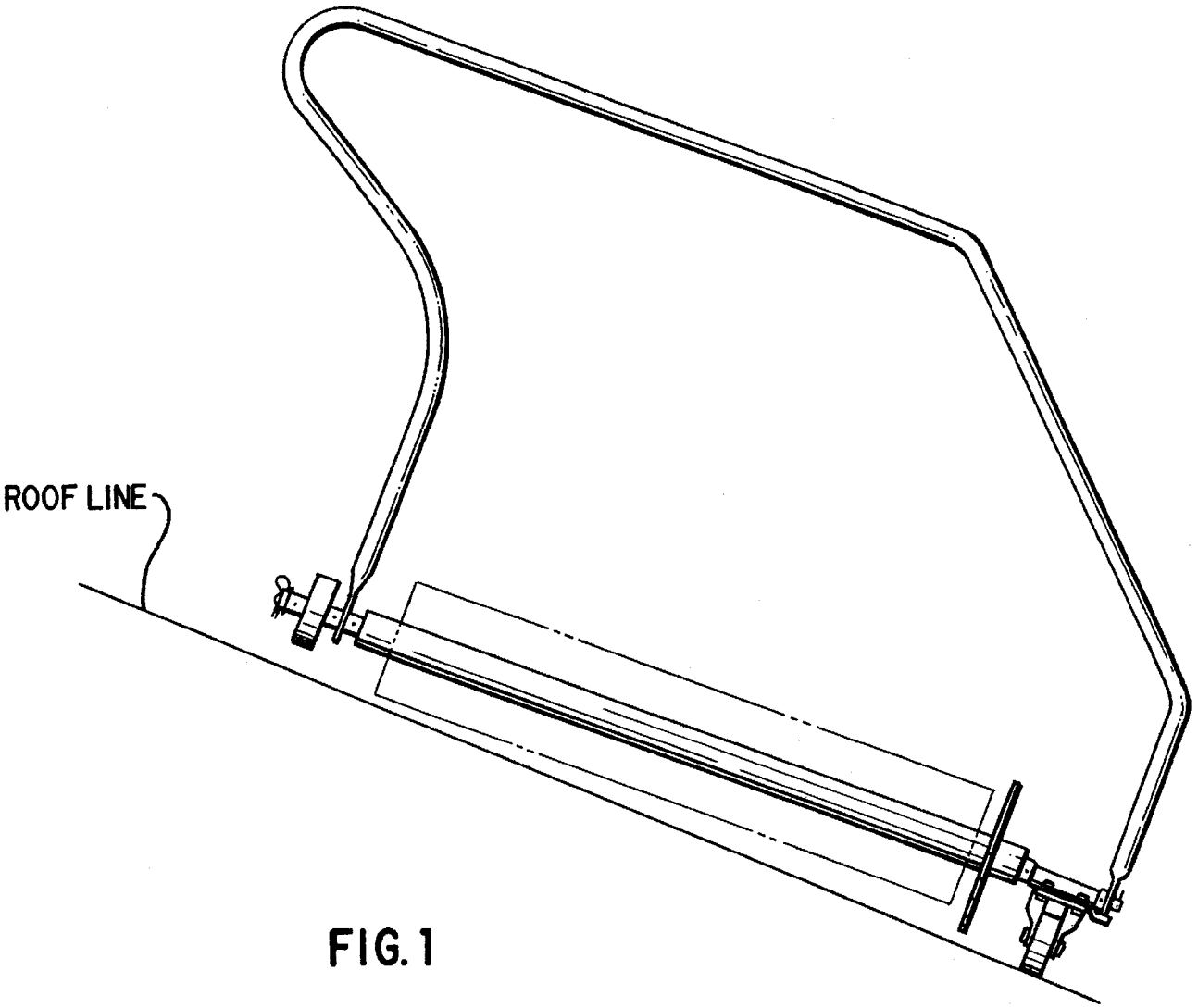
FIG. 1 is a side view of the invention positioned on a pitched roof with the handle in its highest pivoted position with the dotted lines representing the roll of felt material and the caster wheels displayed in their locked position.
Figure 2:
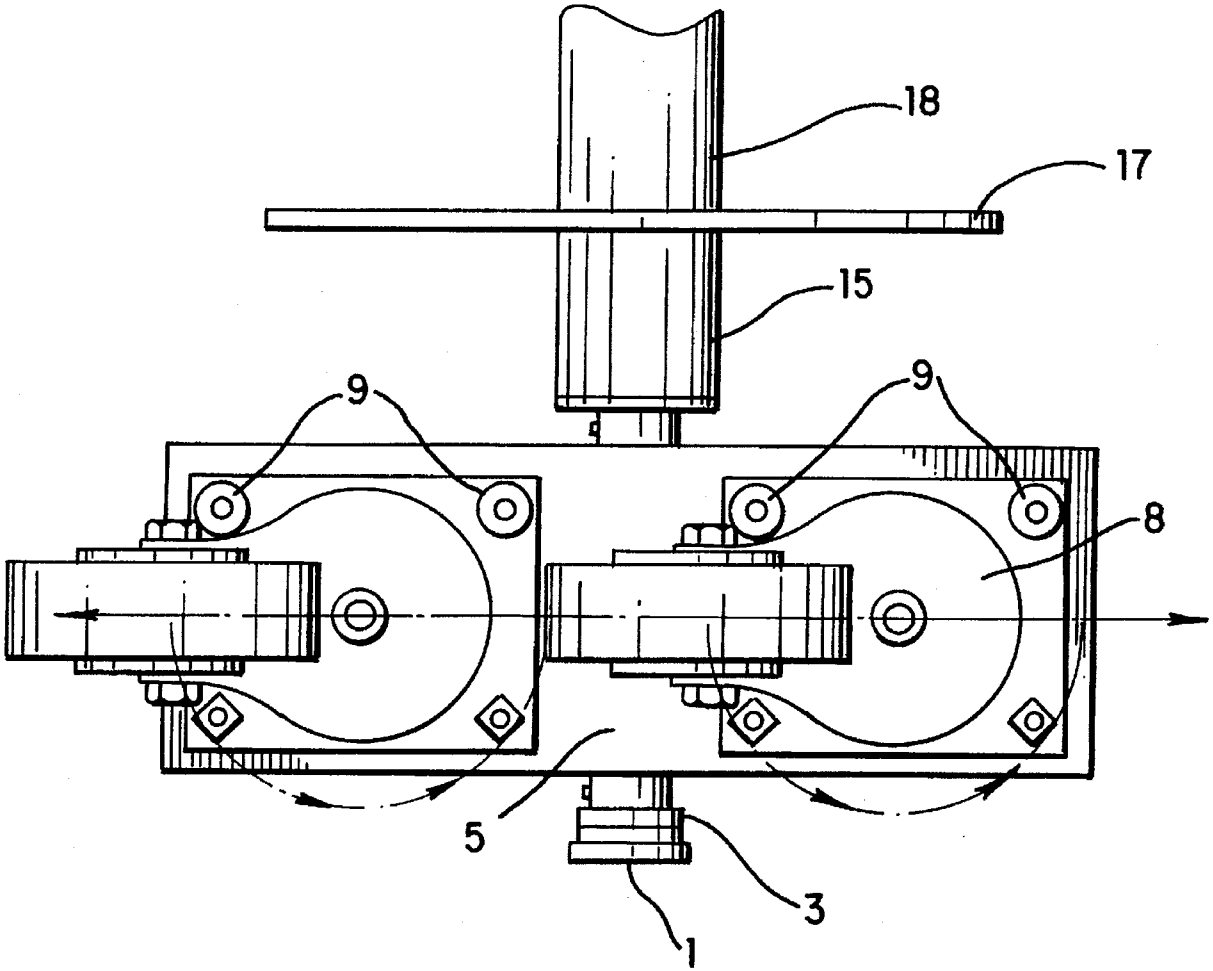
FIG. 2 is a bottom view of the lower end of the invention which shows the caster wheels in their locked position with the straight dotted line indicating the direction of travel of the device and the circular dotted lines representing the possible wheel directions attained in usage.
Figure 3:
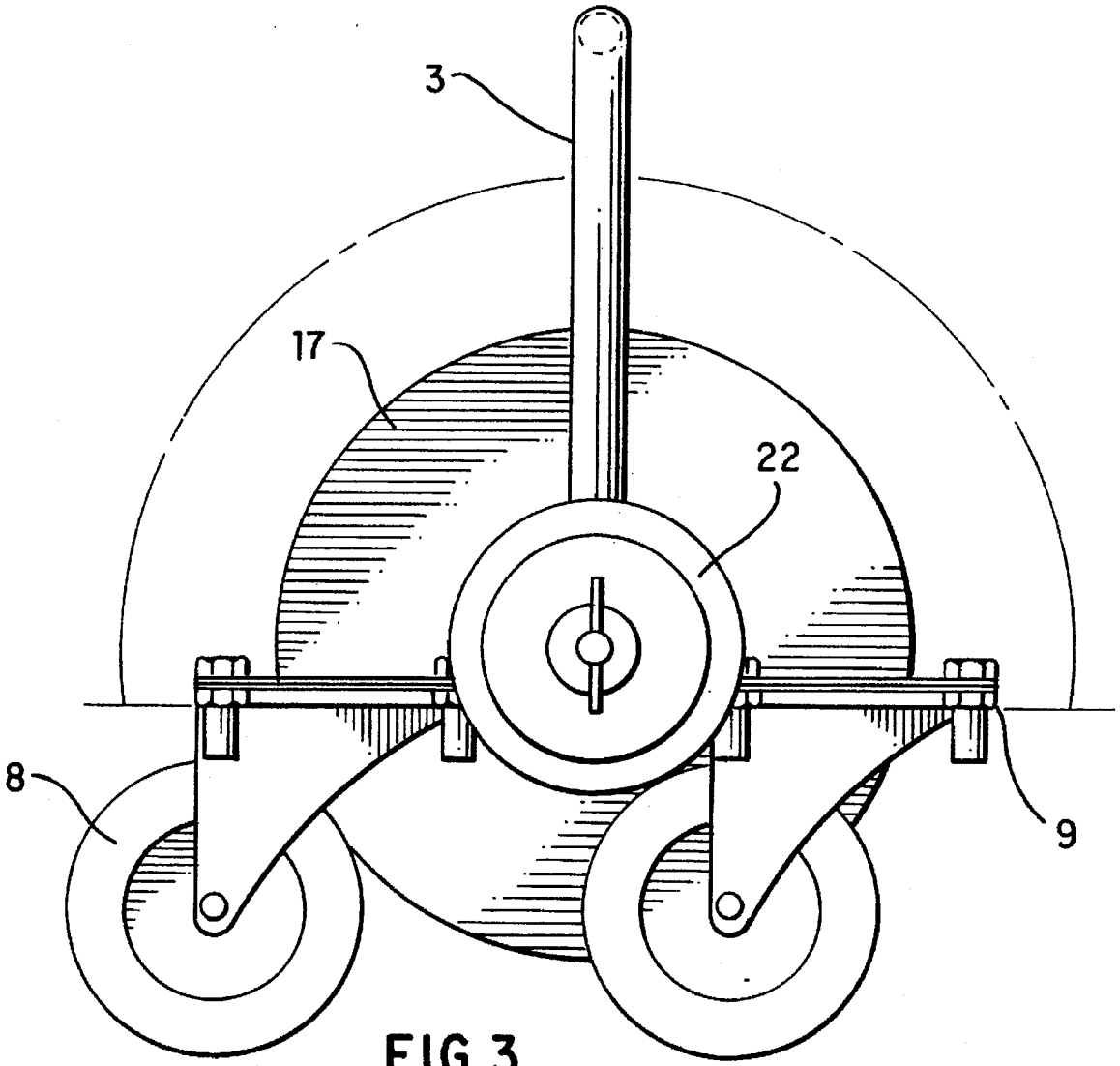
FIG. 3 is an end view from the upper end of the invention with the dotted lines indicating the directions of rotation of the handle.
Figure 4:
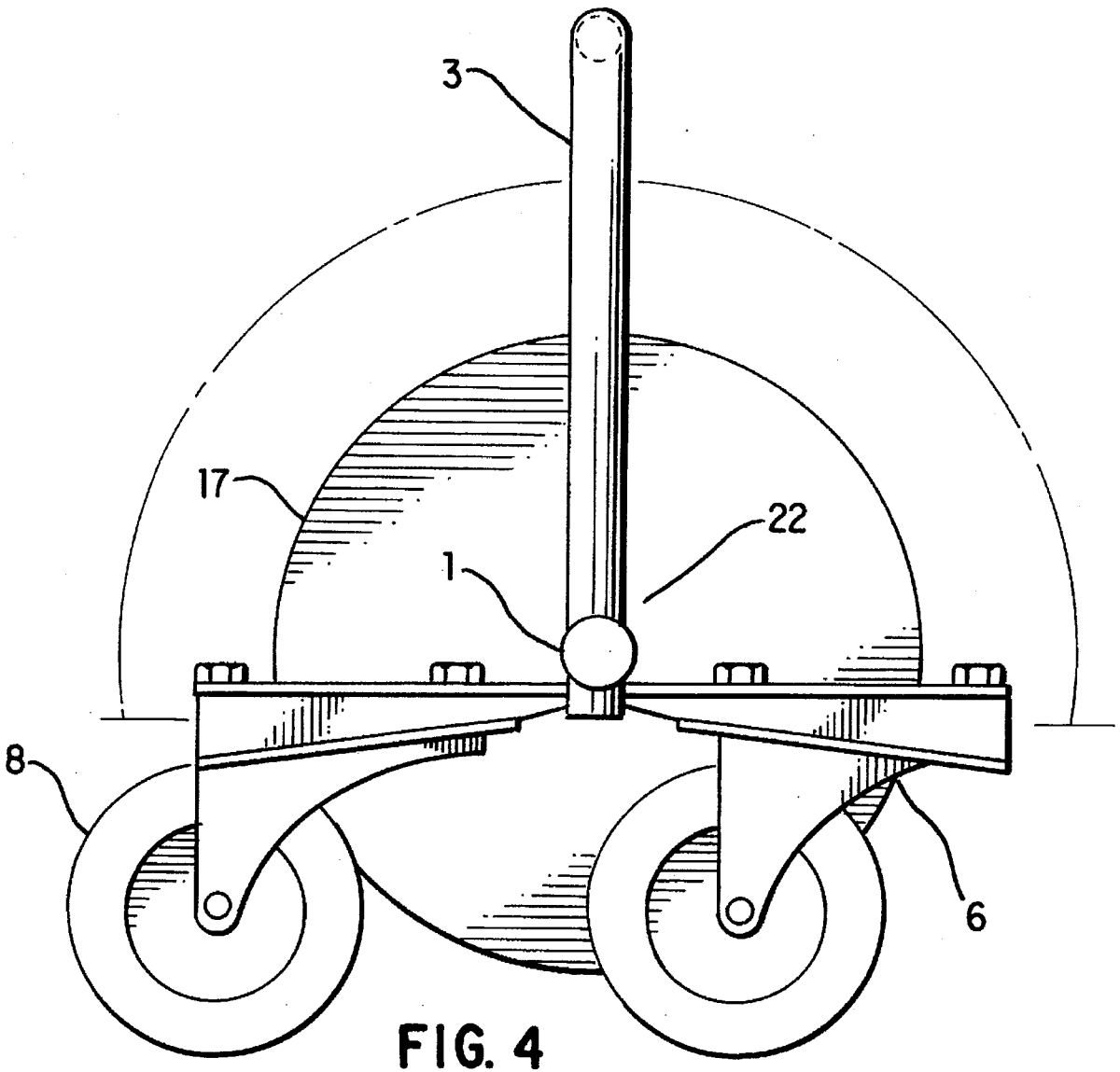
FIG. 4 is an end view from the lower end of the device.

The axle 1 extends through an inner sleeve 19 to a point a sufficient distance so as to receive the retainer pin 23. The inner sleeve 19 extends through the bore in handle 3 and through a support wheel 22 which provides a contact point with the roof at the upper end of the unit. The handle 3 extends up and out to a point axially outward of the device as can be seen in FIG. 1 and back toward the lower end and down to attach to the axle 1. The support wheel 22 and handle 3 are secured to the upper end of the device by three retainer rings 20 provided with set screws, which rings are received by the inner sleeve 19 and which allow rotation of the support wheel and handle. Upon removal of retainer pin 23 the support wheel 22, retaining rings 20 and handle 3 can be slid from the axle to allow loading of a roll of felt material.

In operation a felt roller unit is positioned on a pitched roof and a roll of felt material is loaded onto the unit. The unit can be used in a stationary position allowing dispensing of the material or can be moved for a tack and roll dispensing operation to the left, right, or up in any direction. The gravity induced movement of the caster wheels in a direction perpendicular to the length of the device allows movement of the unit along the length of the roof in a right or left direction with little physical effort and prevents the unit from rolling down the roof. The handle allows for manipulation of the unit from an uphill, standing position. The felt roller unit is completely functional on roof pitches up to and including an 8" rise/12" run and can be utilized in its stationary dispensing position on roofs beyond that pitch.

I claim:

1. A felt roller unit for the dispensing of felt paper in roll form in a pitched roof environment comprising:

a roller pin assembly for supporting a roll of felt material for free spinning rotation about an axis;

means allowing loading of a roll of material on the roller pin assembly;

a caster wheel assembly including at least one caster wheel supported at one end of the felt roller unit for rotatably supporting the roller unit for movement along a roof;

a handle attached to the roller unit for manipulation of the unit by a user; and means for limiting rotation of the at least one caster wheel beyond a position perpendicular to the roll rotation axis whereby gravity induced rotation of the at least one caster wheel when on a pitched roof positions the caster wheel perpendicular to the roll rotation axis which prevents movement of the unit down the roof.

2. The felt roller unit of claim 1 in which the roller pin assembly, the caster wheel assembly and the means allowing loading are supported by an axle.

3. The felt roller unit of claim 1 in which two caster wheels are provided and the means for limiting rotation of the caster wheels comprises bolts extending into the path of rotation of the caster wheels.

4. The felt roller unit of claim 1 in which the roller pin assembly includes bearings for supporting the roller pin assembly for free spinning dispensing of the felt material.

5. The felt roller unit of claim 1 further including a support wheel at the other end of the unit.

6. The felt roller unit of claim 1 wherein the handle extends up from the other end of the unit and axially outward to a point beyond the unit and back along the length of the unit and down to attach to the one end of the unit.

7. The felt roller unit of claim 2 further including a retainer pin at one end of the axle.

* * * * *